US006963170B2

(12) United States Patent
Higgins

(10) Patent No.: US 6,963,170 B2
(45) Date of Patent: Nov. 8, 2005

(54) LAMP MONITOR AND LAMP

(75) Inventor: Christopher Higgins, Lancashire (GB)

(73) Assignee: Tapeswitch Ltd., Chorley (GB)

( * ) Notice: Subject to any disclaimer, the term of this patent is extended or adjusted under 35 U.S.C. 154(b) by 0 days.

(21) Appl. No.: 10/375,461

(22) Filed: Feb. 27, 2003

(65) Prior Publication Data

US 2003/0218436 A1 Nov. 27, 2003

(30) Foreign Application Priority Data

Mar. 1, 2002 (GB) ..... 0204836

(51) Int. Cl.[7] ..... H05B 37/04

(52) U.S. Cl. ..... 315/134; 315/149; 315/291; 315/308

(58) Field of Search ..... 315/129, 134, 315/149, 291, 299, 307, 308; 340/641, 644, 693.4

(56) References Cited

U.S. PATENT DOCUMENTS

| | | | | | |
|---|---|---|---|---|---|
| 3,825,914 | A | * | 7/1974 | Schacket | 340/511 |
| 4,234,878 | A | * | 11/1980 | Stark | 340/642 |
| 4,348,613 | A | * | 9/1982 | Hormel et al. | 315/130 |
| 4,449,073 | A | | 5/1984 | Mongoven et al. | 315/130 |
| 4,496,905 | A | | 1/1985 | Forte et al. | 324/414 |
| 4,584,555 | A | | 4/1986 | Domorazek | 340/458 |
| 4,661,717 | A | | 4/1987 | Nishioka | 340/458 |
| 4,667,187 | A | * | 5/1987 | Volk et al. | 340/641 |
| 4,675,574 | A | | 6/1987 | Delflache | 315/130 |
| 4,808,975 | A | * | 2/1989 | Hochhaus et al. | 340/641 |
| 5,381,131 | A | | 1/1995 | Mochizuki et al. | 340/630 |
| 5,406,442 | A | * | 4/1995 | Kristensen | 361/187 |
| 5,479,159 | A | | 12/1995 | Kelly et al. | 340/10.1 |
| 5,614,790 | A | | 3/1997 | Fleck, Sr. et al. | 315/135 |
| 6,028,396 | A | | 2/2000 | Morrissey, Jr. et al. | 315/119 |
| 6,087,834 | A | | 7/2000 | Tury et al. | 324/414 |
| 6,373,255 | B2 | | 4/2002 | Tury et al. | 324/414 |
| 6,396,216 | B1 | | 5/2002 | Noone et al. | 315/119 |
| 2001/0045833 | A1 | | 11/2001 | Tury et al. | 324/508 |

FOREIGN PATENT DOCUMENTS

| | | |
|---|---|---|
| DE | 2553450 A1 | 6/1977 |
| DE | 2741054 A1 | 3/1979 |
| EP | 434859 B1 | 7/1991 |
| EP | 774884 A2 | 5/1997 |
| EP | 928126 A2 | 7/1999 |
| EP | 1076478 A2 | 2/2001 |
| FR | 2664785 A1 | 1/1992 |
| FR | 2670648 A1 | 6/1992 |
| FR | 2754667 A1 | 4/1998 |
| GB | 1113958 A | 5/1968 |
| GB | 2102968 A | 2/1983 |
| WO | WO 00/18610 A1 | 4/2000 |

* cited by examiner

*Primary Examiner*—Thuy Vinh Tran
(74) *Attorney, Agent, or Firm*—Philip O. Post

(57) ABSTRACT

The present invention discloses a lamp comprising a lamp housing mounting an electrically driven light and a monitor circuit, the housing having power supply terminals for connection of the light to a power supply and the monitor being connected to the light such as to monitor its operation while the lamp is connected to the power supply and to provide an output indicating whether the light is functioning.

13 Claims, 3 Drawing Sheets

LAMP MONITOR AND LAMP

CROSS REFERENCE TO RELATED APPLICATIONS

Not applicable.

FIELD OF THE INVENTION

The present invention is concerned with monitoring of lamps.

BACKGROUND OF THE INVENTION

It is necessary in various situations to electronically monitor whether an electrical lamp (be it a filament bulb, light emitting diode—LED—or some other type of lamp) is functioning correctly. A field of particular importance to the inventor concerns "mute lamps".

Mute lamps are used in conjunction with potentially hazardous machinery. Many machines have safety systems, such as automatic emergency shut-off arrangements, which need from time to time to be temporarily disabled (or "muted") to enable the machine to carry out its proper function. Safety regulations allow for this muting of the safety system but require that for its duration a warning must be provided by illumination of the mute lamp. Furthermore a fail safe arrangement must be provided to ensure that if the lamp should fail then the muting is automatically prevented—i.e. the safety system is activated. Hence the functioning of the mute lamp must itself be automatically monitored.

A known safety arrangement utilising a mute lamp is illustrated in FIG. 1. A safety light curtain 100 is intended to detect the presence of a person in a hazardous area and is connected to a mute control unit 102 whose outputs 104 are led to a controller (not illustrated) capable of shutting down the associated machinery. The mute control unit 102 also receives inputs from sensors 106 and is connected to a mute lamp 108.

This type of arrangement is needed where the light curtain 100 can be triggered not only by a person in the hazardous zone (the response to which should be to shut down the machinery) but also by, for example, the intentional movement of products under manufacture through the zone (in which case the machinery must not be shut down if it is to perform its function). To make it possible for the machinery to continue functioning in the latter situation, the mute control unit is capable of muting the response to the light curtain in response to the mute sensors 106. When the sensors 106 are triggered, the mute control unit applies a voltage to the mute lamp 108 and, provided that it detects that the lamp is illuminated to provide a visible warning, causes muting of the response to the light curtain so that triggering of the curtain does not cause the machinery to be shut down. If, however, the mute control unit 102 detects that the lamp 108 is not illuminated then muting does not take place. The light curtain thus remains active if the mute lamp malfunctions.

Known circuitry for monitoring of mute lamps is incorporated in the mute control unit and uses a current sensing resistor connected in series with the lamp, voltage across the resistor being electronically monitored so that if it falls below a chosen threshold (indicating inadequate current flow for lamp function) or rises above a chosen threshold (indicating that the lamp's resistance has fallen excessively due to failure thereof) then a signal is generated to indicate lamp failure and so prevent muting of the safety system.

The mute control unit is typically somewhat bulky and is housed in a unit separate from the lamp itself.

It must be understood however that the invention is applicable to lights in general and not only to mute lights. There are many contexts in which it is desirable to provide, in a compact unit, a means of monitoring the functioning of a lamp.

BRIEF SUMMARY OF THE INVENTION

In accordance with a first aspect of the present invention there is a lamp comprising an electrically driven light source and a monitor circuit both mounted by a lamp housing to form a single unit, the lamp having power supply terminations for connection of the light to a power supply and the monitor circuit comprising a series combination of a sensing resistor and a series resistor, the combination being connected across the power supply terminations, the first resistance also being connected in series with the light, and control inputs of a first solid state switching device being connected across the sensing resistance so that the state of the switching device is controlled by voltage across the sensing resistance, outputs of the switching device being led to output terminations of the lamp to provide an indication whether the light is illuminated.

By virtue of the formation of the monitor circuit the light and the monitor circuit can be compactly packaged in a single unit, a considerable advantage over earlier more bulky arrangements in which the light and the monitor circuit were separate units which needed to be connected together.

It is highly desirable (and in certain cases, due to industrial regulations, mandatory) that the monitor circuit should be "fail safe" in that if it malfunctions and so provides a false output, that output should be of the type indicative of a failure of the light. A false output of the opposite type, suggesting that the lamp is illuminated when it has in fact failed, would be potentially dangerous.

For example where the lamp in question is a mute lamp, the desirable fail safe operation would lead, in the event of failure of the monitor circuit, only to the associated safety system being re-activated. No danger therefore arises. On the other hand a failure of the monitor circuit which led to a false output indicative of illumination of the mute lamp could lead to a potentially dangerous situation in which the safety system was muted even though the mute lamp was not in fact illuminated.

It has been found by the inventor, and confirmed in independent product certification trials, that circuits constructed in accordance with the present invention can be "fail safe" in this sense. More specifically, circuits constructed in accordance with the present invention have been shown to be fail safe against the failure of any single component of the circuit. That is, the present invention makes it possible to design the monitor circuit such that the failure of any single circuit component cannot lead to a false indication that the light is functioning correctly.

Preferably the first switching device provides a pair of outputs which are conductive in a first state indicative of illumination of the light and non conductive in a second state of the switching device indicative of a fault. This too contributes to the fail safe operation of the lamp, since a break in a connection to the lamp outputs is interpreted as a fault rather than being falsely interpreted as indicative of proper functioning of the light.

Preferably, the first solid state switching device is connected across the sensing resistance through a second solid state switching device which is arranged to break the connection in response to an open circuit condition of the light. Hence the first switching device responds to both an open circuit and a closed circuit condition of the light. The second solid state switching device may have inputs connected across the aforementioned series resistor.

Redundancy may be provided, again for the purpose of ensuring failsafe operation, by providing a third switching device in parallel with the first.

In accordance with a second aspect of the present invention there is a light driving and monitoring circuit comprising a pair of power supply terminals for connection to a supply, a potential divider formed by first and second resistances connected across the supply terminals, a light connected across the first resistance, and first and second solid state switching devices, the first solid state switching device being connected such as to respond to voltage across the second resistance and the second solid state switching device being connected such as to respond to voltage across the light, the first and second solid state switching devices controlling a circuit output to provide an indication whether the light is functioning.

BRIEF DESCRIPTION OF THE DRAWINGS

Specific embodiments of the present invention will now be described, by way of example only, with reference to the accompanying drawings in which.

DETAILED DESCRIPTION OF THE INVENTION

Figure 1:
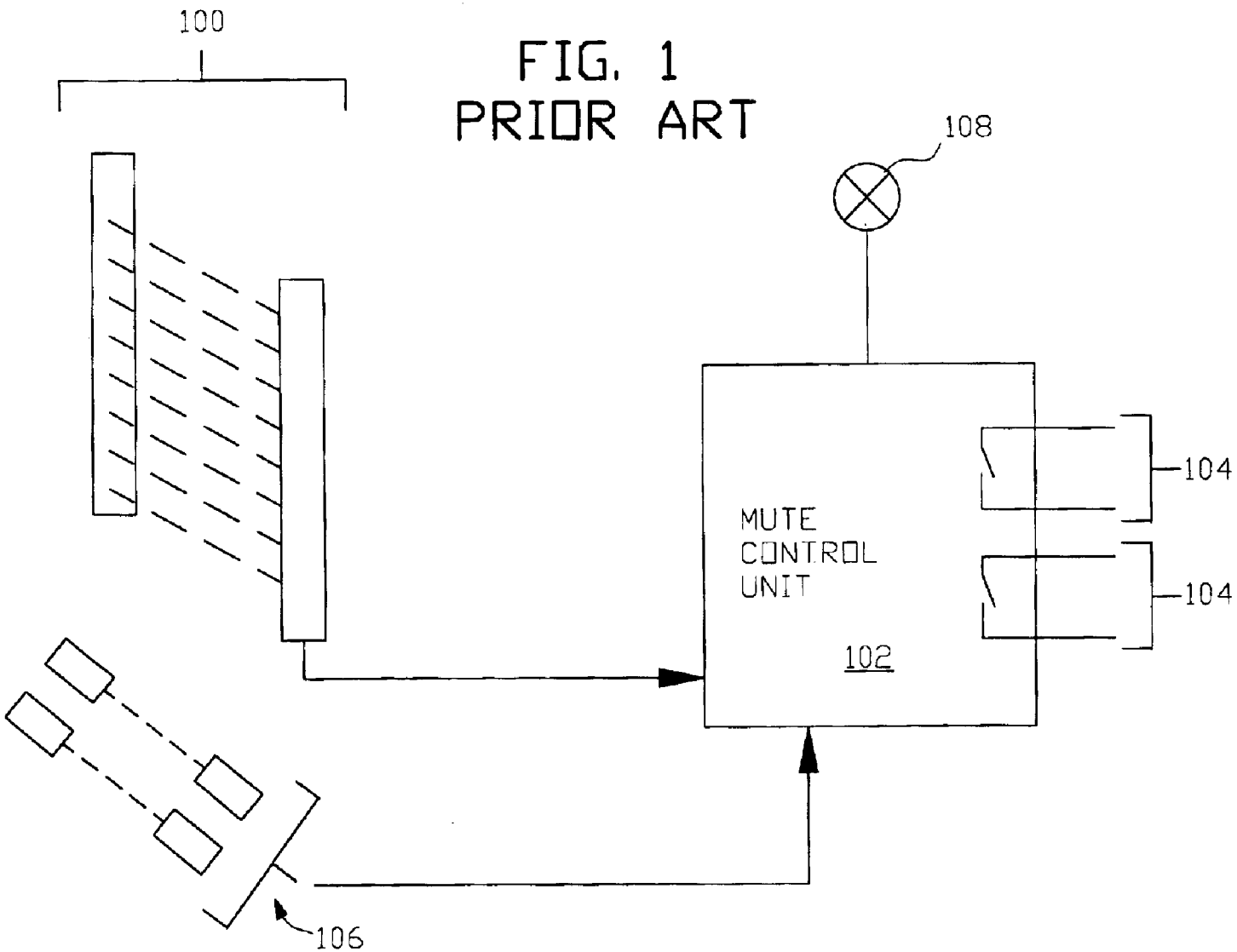
FIG. 1 PRIOR ART
FIG. 1 is a block diagram of a known safety arrangement incorporating a mute lamp.
Figure 2:
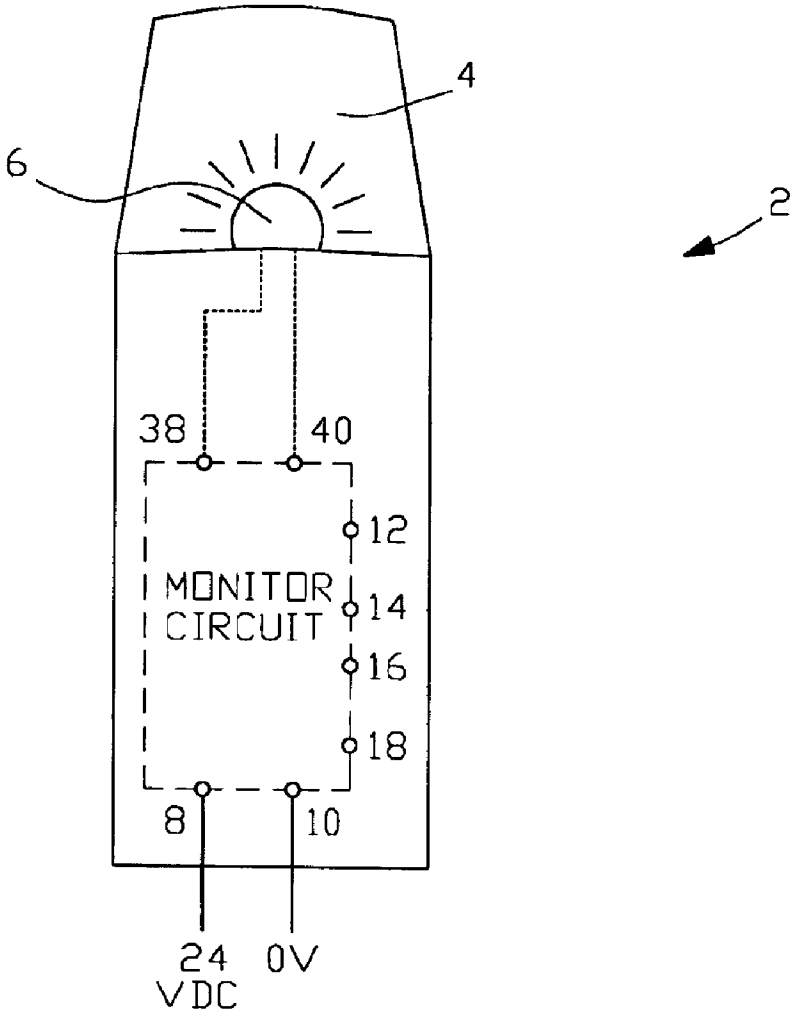
FIG. 2 is a stylised illustration of a lamp embodying the present invention.

In FIG. 2 a lamp 2 is seen to comprise a lamp housing 4 containing an electrically driven light which in this embodiment is an incandescent bulb 6, although the present invention is equally applicable to lights of other types including LEDs. Also contained by the housing 4 is a monitor circuit, to be described below, connected to (1) power supply terminals 8, 10 for connection to a DC supply, (2) a first pair of monitor output terminals 12, 14 and (3) a second pair of monitor output terminals 16, 18.

Figure 3:
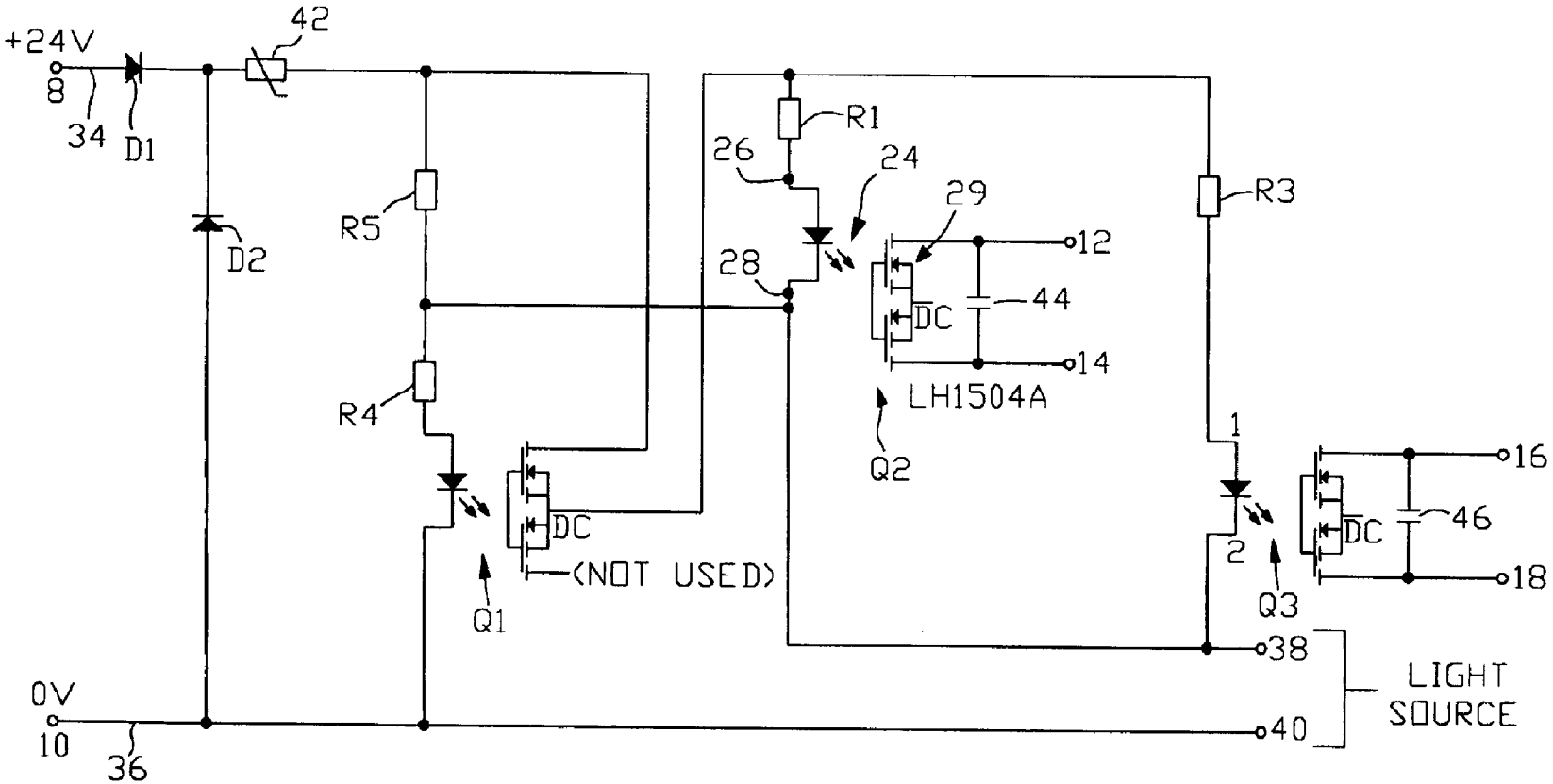
FIG. 3 is a diagram of a lamp monitor circuit suitable for use in the FIG. 2 lamp and embodying the present invention.

The two pairs of output terminals are controlled by respective solid state switching devices Q2, Q3 as shown in FIGS. 2 and 3. While devices of other types could be used, the illustrated embodiments have solid state switching devices formed as solid state relays and still more specifically as opto-isolators. Such devices are known in themselves. A suitable component is supplied under the reference LH1540. Opto-isolators use an LED 24 connected between device inputs 26, 28 (see FIG. 3) to control a semiconductor junction 29 acting in a manner analogous to the contacts of an electromechanical relay. Application of a suitable potential to the inputs 26, 28 causes the device to adopt an "on" state in which there is low resistance between its outputs 12, 14—i.e. the outputs can be said to be conductive. In the absence of such a potential, the device adopts an "off" state in which resistance between the outputs e.g. 12, 14 is high—i.e. the path across the outputs is effectively non-conductive.

The monitor circuit depicted in FIG. 3 has high and low rails 34, 36 respectively connected to the power supply terminals 8, 10. The light itself is not shown in this drawing but is connected by light terminals 38, 40 across the rails 34, 36 through a low value resistor R5, being thereby supplied with power. Protection for the light and the monitor circuitry is provided by diodes D1 and D2 connected respectively in series with the high rail 34 and across the rails 34 and 36, and also by a PTC 42 connected in the high rail and serving analgously to a fuse. Resistor R5 is connected in a potential divider configuration, being led on one side to the high rail and on its other side to (1) the light terminal 38 and (2) via a higher value resistor R4, to an input of first opto-isolator Q1 and so to the low rail. The outputs of the first opto-isolator Q1 are connected respectively to the high rail and, via respective resistors R1, R3, to inputs of two further opto-isolators Q2, Q3. Opposite inputs of opto-isolators Q2, Q3 are connected to the light terminal 38 and hence also to the mid point of the potential divider formed by resistors R4 and R5. Outputs of the two opto-isolators Q2, Q3 are led to the two pairs of output terminals 12, 14 and 16, 18 at the exterior of the lamp housing. Smoothing capacitors 44, 46 across the output terminal pairs remove "bounce" so improving the output signal quality.

The operation of the circuit is as follows. At the moment the lamp is switched on the filament is cold and its resistance is therefore low. The voltage developed across R4 and the inputs of opto-isolator Q1 is therefore low. Q1 is consequently off (i.e. non-conductive) as are Q2 and Q3. If the lamp is functioning correctly, the filament quickly heats up and its resistance correspondingly increases. Purely by way of example, the illustrated circuit is driven from a 24 volt supply and has a light with an operating resistance of about 82 ohms. R5 has in this example a value of 6.8 ohms so voltage across the light stabilises at approximately 22 volts. The same voltage is applied to the inputs of Q1 causing it to switch on, which allows current to flow through R1 and R3 to switch on opto-isolators Q2 and Q3. Hence in this state, corresponding to proper lamp function, output terminal pairs 12, 14 and 16, 18 are both conductive.

If the light should fail in such a way as to become open circuit then voltage across resistor R5 is determined by the potential divider formed by R5, R4 and Q1. R4 is much larger than R5. In the illustrated example R4 is 2.2 kohms. Voltage across R5, and across the inputs of Q2 and Q3 is thus less than 74 mV and both Q2 and Q3 are turned off—i.e. the output terminal pairs 12, 14 and 16, 18 are non-conductive.

If the light should fail in such a way as to become short circuit then opto-isolator Q1 is likewise short circuited and so turns both Q2 and Q3 off—i.e. the output terminal pairs 12, 14 and 16, 18 become non-conductive. In this state a low resistance path would be created between the drive rails through R5 were it not for PTC 42 which becomes high impedance.

The output terminal pairs 12, 14 and 16, 18 function in the same manner as each other, providing redundancy to improve reliability. Both are typically connected to a separate control unit. For example where the lamp is used as a mute lamp the outputs may be connected to a bus remote I/O block and thereby to a data bus controlling associated machinery. Note that the outputs are conductive to indicate proper lamp operation and non conductive to indicate a lamp fault. This is desirable for the sake of safety since e.g. disconnection of the outputs is interpreted as failure, leading to emergency action, rather than being misinterpreted as indicative of proper lamp function.

The circuit is suitable for use in a mute lamp and has been demonstrated to be "fail safe" in that failure of any single component of the monitor circuit, while it may lead to a false indication that the light has failed, cannot produce an indication that the lamp is illuminated when it has in fact failed and become either open or closed circuit.

What is claimed is:

1. A lamp comprising an electrically driven light source and a monitor circuit, both mounted by a lamp housing to form a single unit, the lamp having power supply terminals for connection of the light source to a power supply, the monitor circuit comprising:

a first resistor;

a second resistor, the second resistor having a resistance greater than the resistance of the first resistor;

a first solid state switching device having an input and an output, the first resistor, the second resistor and the input of the first solid state switching device connected in series across the terminals of the power supply, the first resistor and the light source connected in series across the first and second terminals of the power supply to illuminate the light source, a first terminal of the light source connected to a first terminal of the first resistor, a second terminal of the light source connected to the second terminal of the power supply, a second terminal of the first resistor connected to the first terminal of the power supply, a state of the output of the first solid state switching device responsive to a value of the voltage across the first resistor;

a third resistor; and a second solid state switching device having an input and an output, the output of the first solid state switching device, the third resistor, and the input of the second solid state switching device connected in series across the first terminal of the power supply and the first terminal of the light source, the common connection between the series connected first and second resistors connected to a common connection between the series connected input of the second solid state switching device and the first terminal of the light source, the output of the first solid state switching device controlling the input of the second solid state switching device, the input of the second solid state switching device controlling the output of the second solid state switching device.

2. The lamp as claimed in claim 1 which is constructed such that no failure of any single component can produce an illuminated light source state of the output of the first solid state switching device when the light source is not illuminated.

3. The lamp as claimed in claim 1 wherein at least one of the first and second solid state switching devices is a solid state relay or an opto-isolator.

4. The lamp as claimed in claim 1 wherein an illuminated light source causes a first value of voltage across the first resistor so that the output of the first solid state switching device adopts a first state in which the light source is illuminated, and the output of the second solid state switching device adopts the first state responsive to the output of the first solid state switching device and the input of the second solid state switching device; and an open circuit light source causes a second value of voltage across the first resistor so that the output of the first solid state switching device adopts a second state in which the light source is not illuminated, and the output of the second solid state switching device adopts the second state responsive to the output of the first solid state switching device and the input of the second solid state switching device.

5. A lamp as claimed in claim 4 which is constructed such that no failure of any single component can produce the illuminated light source state of the output of the first solid state switching device when the light source is not illuminated.

6. A lamp as claimed in claim 4 wherein at least one of the first and second solid state switching devices is a solid state relay or an opto-isolator.

7. The lamp as claimed in claim 1 further comprising:

a fourth resistor; and a third solid state switching device having an input and an output, the fourth resistor and the input of the third solid state switching device connected in series across the series combination of the third resistor and the input of the second solid state switching device, the output of the first solid state switching device controlling the input of the third solid state switching device, the input of the third solid state switching device controlling the output of the third solid state switching device.

8. The lamp as claimed in claim 7 which is constructed such that no failure of any single component can produce the illuminated light source state of the output of the first solid state switching device when the light source is not illuminated.

9. The lamp as claimed in claim 7 wherein at least one of the first, second and third solid state switching devices is a solid state relay or an opto-isolator.

10. The lamp as claimed in claim 7 wherein the outputs of the second and third solid state switching devices adopt an illuminated light source state responsive to the output of the first solid state switching device when a first value of voltage is across the first resistor, and to the inputs of the second and third solid state switching devices, respectively; and the outputs of the second and third solid state switching devices adopt a non illuminated light source state responsive to the output of the first solid state switching device when a second value of voltage is across the first resistor, and to the inputs of the second and third solid state switching devices, respectively.

11. The lamp as claimed in claim 1 wherein a short circuit of the light source short circuits the input of the first solid state switching device, the short circuiting of the input of the first solid state switching device causing the output of the first solid state switching device to adopt a non illuminated light source state, and the output of the second solid state switching device adopts the non illuminated light source state responsive to the output of the first solid state switching device and the input of the second solid state switching device.

12. A method of providing redundantly fail-safe detection of whether a light source is illuminated or not illuminated, the method comprising the steps of:

connecting the light source and a first resistor across the first and second terminals of a power supply;

connecting the first resistor, a second resistor and the input of a first solid state switching device across the terminals of the power supply;

connecting the output of the first solid state switching device, a third resistor and the input of a second solid state switching device across the first terminal of the power supply and the terminal of the light source connected to the first resistor; and containing the light source, the first, second and third resistors, and the first and second solid state switching devices in a common enclosure;

whereby the outputs of both the first and second solid state switching devices adopt a first state when the light source is illuminated and a second state when the light source is not illuminated.

13. The method of claim 12 further comprising the steps of connecting a fourth resistor and the input of a third solid state switching device across the third resistor and the input of the second solid state switching device, and containing the fourth resistor and third solid state switching device in the common enclosure, whereby the outputs of the first, second and third solid state switching devices adopt the first state when the light source is illuminated and the second state when the light source is not illuminated.

* * * * *